United States Patent [19]

Jacobs

[11] 4,035,009

[45] July 12, 1977

[54] CONTAINER AND LOCKING LID

[76] Inventor: Stanley A. Jacobs, 45 Kohary Drive, New Haven, Conn. 06515

[21] Appl. No.: 473,798

[22] Filed: May 28, 1974

[51] Int. Cl.[2] ..... E05C 19/10

[52] U.S. Cl. ..... 292/246; 292/259 R; 292/DIG. 49

[58] Field of Search ..... 292/246, 204, 103, 257, 292/DIG. 49, 259

[56] References Cited

U.S. PATENT DOCUMENTS

| | | | |
|---|---|---|---|
| 322,211 | 7/1885 | Taylor | 292/204 |
| 493,456 | 3/1893 | Violet | 292/246 |
| 597,051 | 1/1898 | Danz | 292/246 |
| 658,343 | 9/1900 | Clark | 292/259 |
| 751,450 | 2/1904 | Beck | 292/DIG. 49 |
| 1,019,094 | 3/1912 | Skahen | 292/257 |
| 1,469,196 | 9/1923 | Strange | 292/246 |
| 1,727,087 | 9/1929 | Wendle | 292/246 |
| 2,793,063 | 5/1957 | Hurley | 292/259 |
| 3,176,880 | 4/1965 | Archbold | 292/257 |
| 3,490,805 | 1/1970 | Pierro et al. | 292/DIG. 49 |

FOREIGN PATENT DOCUMENTS

| | | | |
|---|---|---|---|
| 324,920 | 2/1930 | United Kingdom | 292/103 |

*Primary Examiner*—Paul R. Gilliam
*Assistant Examiner*—Victor N. Sakran
*Attorney, Agent, or Firm*—Wolf, Greenfield & Sacks

[57] ABSTRACT

An improved latching arrangement is provided for a container and lid of the type in which the container has a flexible, resilient sidewall. Latching arms are pivoted to opposite sides of the container sidewall and engage loops which depend from the periphery of the lid. Each of the latching arms is mounted to the container sidewall in a manner such that when the latching arm is pivoted between its locked and unlocked positions a portion of the latching arm interferes with the flexible sidewall of the container which causes the container to flex, resiliently and provide a snap action which retains the latch arm in either of the locked or unlocked positions.

10 Claims, 8 Drawing Figures

FIG. 1
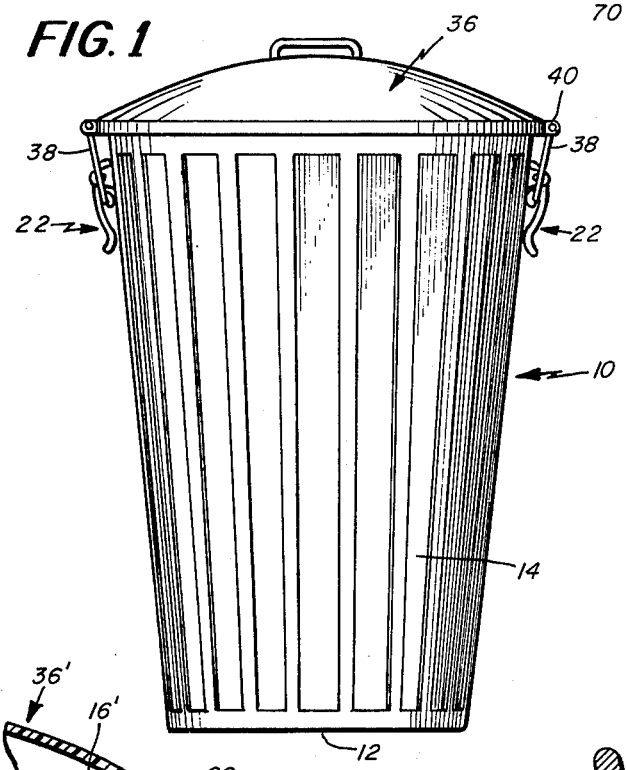
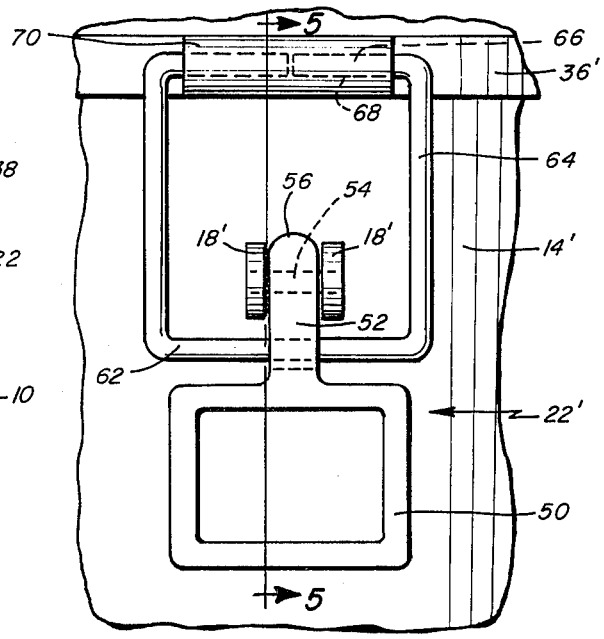
FIG. 4
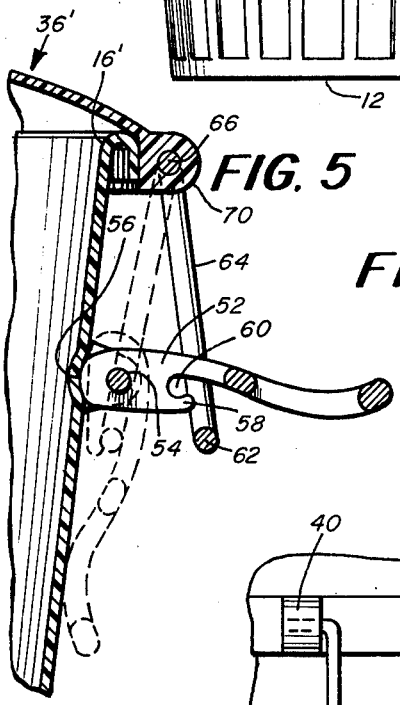
FIG. 5
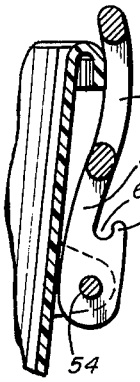
FIG. 6
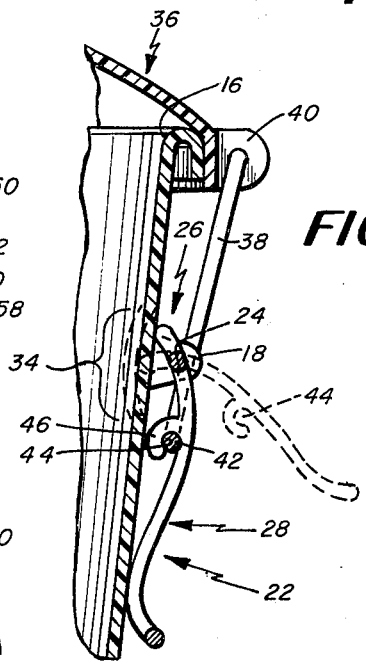
FIG. 3
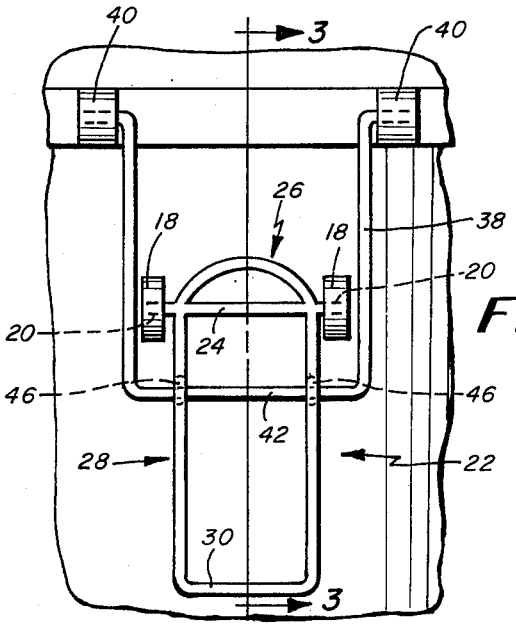
FIG. 2

CONTAINER AND LOCKING LID

BACKGROUND OF THE INVENTION

My invention relates to wide-mouth containers and lockable lids for use therewith such as might be employed in trash cans, paint cans or other similar wide-mouthed containers. In particular, the invention relates to an improved latching arrangement to be used in connection with containers made from plastic or the like in which the container sidewall is flexible and resilient. For example, trash cans usually are fabricated from metal or plastic and have no lid latch. It is not uncommon for trash cans to be overturned by animals or other means. Where the lid is not securely latched to the container overturning of the trash can often results in separation of the lid and spilling of the contents with resulting unsightliness and inconvenience. In addition, where there is no means to securely latch the lid to the container it is not uncommon for the lid and container to become separated and the lid lost which results in further inconvenience.

Efforts have been made to provide trash cans with lid latches and, while they are more effective than a lid having no latch at all, they still present some difficulties in that they do release sometimes when overturned. It is believed that the less than desirable results obtained from such currently employed latches results at least in part from the commercial necessity that the latch be manufactured at minimal expense which, thus far, has resulted in compromising the effectiveness of the latch so that it may be inexpensively manufactured. It is believed that there is a need for a more effective yet inexpensively manufacturable latch.

By way of further example of difficulties encountered with wide-mouthed containers and lids, cans in which paint or adhesive may be packaged typically employ a tight fitting lid having a bead whch engages firmly a peripheral channel formed at the container mouth. After some of the contents of the paint or adhesive can has been used, the bead, almost invariably, becomes filled with paint or adhesive. When reclosing the container the material in the channel may preclude complete closing of the cover which exposes the remaining material in the can to the air, resulting in a very short shelf life for the remaining unused material. This problem may be particularly acute with regard to adhesives which can harden quite rapidly. While it would be desirable to provide such containers with a latch to securely close the cover on the container, it is believed that the added cost for such a latch has been generally prohibitive.

It is a primary object of my invention to provide an improved and inexpensive latching arrangement for a wide-mouthed container and lid which avoids the foregoing and other difficulties.

SUMMARY OF THE INVENTION

The container includes a resilient, flexible sidewall and may be molded from an appropriate plastic material. A pair of latch arms are pivoted to diametrically opposite locations on the sidewall below the mouth of the container. Each of the latch arms is pivotable between a downwardly extending, locked position and and upwardly extending, open position. The inner end of each the latch arm projects from the pivot point by a distance which is greater than that from the pivot point to the sidewall of the container so that when pivoted betwen its locked and unlocked positions the inner end of the latch arm will interfere with the flexible container sidewall, causing the sidewall to yield and enabling the latch arm to snap into its locked or unlocked position. A pair of loops are attached to and hang from diametrically opposite locations with fingers formed on the latching arms. When the latch arms are pivoted to their locked position they draw the loops downwardly to secure the lid firmly to the container.

The invention may also be employed in connection with a container having a normally rigid sidewall by providing a supplemental resilient, flexible member on the sidewall adjacent the inner end of the latch arm. In a further aspect of the invention, the lid may be semi-permanently attached to the container by securing one of the lid loops to its associated latch arm, thus precluding total separation of the lid from the container and minimizing the chance of losing the cover.

It is among the objects of the invention to provide an improved latching arrangement for a wide-mouthed container and lid in which at least a portion of the container sidewall is resilient and flexible.

Another object of the invention is to provide an improved latching arrangement for a wide-mouthed container and lid which is inexpensive to manufacture.

A further object of the invention is to provide an improved latching mechanism for a wide-mouthed container and lid in which the container has a flexible sidewall which also cooperates with the latch handle.

DESCRIPTION OF THE DRAWINGS

The foregoing and other objects and advantages of the invention will be understood more fully from the following detailed description thereof, with reference to the accompanying drawings wherein:

FIG. 1 is a side elevation of a trash container embodying the invention;

FIG. 2 is an enlarged elevation of one of the latches for the container as seen from the side of FIG. 1;

FIG. 3 is a side elevation, partly in section, of the latch shown in FIG. 2 illustrating the latch in its locked and intermediate positions;

FIG. 4 is an elevation of a modified form of the latch;

FIG. 5 is a side elevation, partly in section, of the embodiment shown in FIG. 4 as seen along the line 5—5 of FIG. 4;

FIG. 6 is an illustration of the latch of FIG. 4 in its up, unlocked position;

DESCRIPTION OF THE PREFERRED EMBODIMENT

Figure 7:
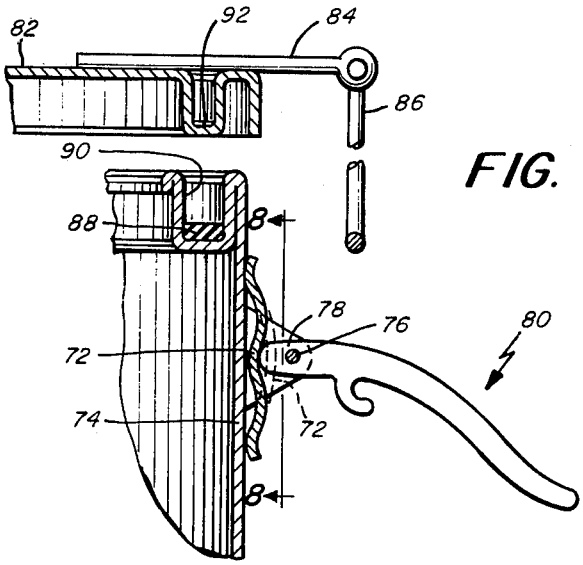
FIG. 7 is an illustration of a further embodiment of the invention which may be employed in connection with containers having normally rigid sidewalls.

FIGS. 1–3 show an embodiment of the invention as incorporated in a one-piece molded plastic trash can. The trash can may be molded in accordance of a variety of known molding procedures and is fabricated from a tough, resilient, flexible plastic material such as polyethylene or the like. The trash can 10 includes a bottom wall 12 and integral sidewall 14 which extends upwardly from the bottom wall 12 and terminates, typically, in a wide-mouthed rim 16. The sidewall 14 includes two pairs of integrally molded trunnions 18, located at diametrically opposite portions of the region of the sidewall and somewhat below the rim 16. The trunnions 18 in each pair are transversely spaced and have transverse holes 20 extending therethrough.

Each pair of trunnions 18 pivotally supports a latch arm, indicated generally at 22. The latch arm 22 include a transversely extending pivot bar 24, the ends of which are received in the holes 20 to provide a pivot axis for the latch arm 22. The latch arm 22 also includes an inner section 26 and an outer section 28, integral with each other and with the pivot bar 24. In the embodiment shown in FIGS. 1–3 the pivot bar 24 and inner and outer sections 26, 28 of the latch arm 22 may be fabricated from sufficiently heavy metal wire stock. The outer section 28 preferably includes a transverse handle portion 30 near its outer extremity. The inner section 28 of the latch arm 22 is bowed and projects away from the pivot bar 24 a distance greater that that between the pivot bar 24 and the portion of the container sidewall 14 which is disposed between the trunnions 18. When the latch arm is pivoted between either of its locked or unlocked positions the inner section 26 will be urged against the region 34 of the container sidewall which, because of its inherent resilient and flexible construction, will yield to permit the latch arm 22 to be pivoted to one or the other positions. Because of the flexibility and resilience of the sidewall the latch handle will have a "snap action" as it is pivoted from one position to the other. The inner section 26 of the handle 22 preferably should be formed so that when the handle is pivoted between its locked and unlocked positions it will engage the flexible region 34 of the sidewall smoothly and without causing too sharp a bend in the plastic material of the sidewall. After the latch handle has been pivoted to the desired position it will be retained by the interfering engagement of the inner section 26 with the container sidewall 14 as shown in solid in FIG. 3.

The container lid 36, which may also be molded from an appropriate plastic material includes a pair of diametrically opposed locking loops 38 which are pivotally secured to the lid and hang downwardly from diametrically opposite portions of the lid 36. The loops 38 may be secured to the lid by means of trunnions 40 to which the upper ends of the loops 38 may be pivoted. The loops 38 are located so that each loop will be engageable with one of the latching arms 22. Each loop includes, at its lower region, a transverse bar 42 which is located so that it may be received within an opening 44 formed on the latch arm 22, the opening 44 being defined by one or more fingers 46 secured to the latch arm. The fingers 46 are arranged so that when the latch arm 22 is in its locked position, the opening 44 faces downwardly to retain the transverse bar 42 of the locking loop 38. The foregoing various parts of the invention are dimensioned so that when the lid is locked to the container, it will fit on the container rim 16 snugly and will be retained thereon.

In some instances it may be desirable to connect one of the locking loops 38 to its associated latch arm 22 in a more permanent manner so as to avoid total separation of the lid and container and thus reduce the risk of losing the lid. To this end, one of the latch arms 22 may be provided with fingers 46 which define an opening 44 slightly narrower than the diameter of the transverse bar 42 which it is to receive. This enables the transverse bar 42 to be snap-fitted into the opening 44 and will tend to retain the lid in semipermanent attachment with the container. In some instances it may be desirable to make a more permanent attachment of the loop 38 to the latch arm 22 and, in that case, the finger or fingers 46 may be bent or otherwise formed to completely close the opening 44.

FIGS. 4, 5, and 6 show a somewhat modified embodiment of the latch arm which may be molded in one piece from sufficiently rigid plastic material. In this embodiment, the arm 22' includes a lower section defining a handle portion 50 which is integral with a neck portion 52. The upper region of the neck 52 has a pin 54 extending therethrough which is pivotally retained between trunnions 18' molded integrally with the sidewall 14' of the container. The neck portion 52 has an inwardly extending portion 56 which extends from the pivot pin 54 a distance greater than that between the pivot pin 54 and sidewall 14' of the container. The outer end of the inner portion 56 preferably is smooth so that when it is pivoted between its locked and unlocked positions it may engage the sidewall and cause it to yield without imposing excessive stress on the sidewall. The neck portion 52 of the latch arm 22' also includes an integrally molded finger 58 which defines an opening 60 receptive to the lower transverse portion 62 of the lid loop 64. In this embodiment, the lid loop 64 is of substantially rectangular configuration having upper ends 66 which extend toward each other and which are received through opposite ends of a hole 68 formed in a lug 70 molded integrally with the lid 36'. As with the previously described embodiment, the dimensions at the mouth of the opening 60 may be somewhat smaller than the diameter of the transverse portion 62 of the loop 64 to provide a somewhat permanent attachment between the loop and the latch arm thereby minimizing the risk of losing the lid.

In each of the described embodiments, it is preferred to fabricate the outer extremity of the outer end of the handle so that when it is in its locked configuration, the outer extremity extends slightly away from the container sidewall to make it easier to grip and operate the latch arm. This is shown more clearly in FIGS. 3 and 5 from which may be seen that the extremity of the outer end of the latch arm is curled away from the container sidewall. Additionally, it may be desirable to locate the trunnions 18 or 18' so that the pivot point is positioned in a manner that when the handle is in its uppermost position (e.g., FIG. 6) the outer end of the handle will extend slightly above the rim of the container.

Figure 8:
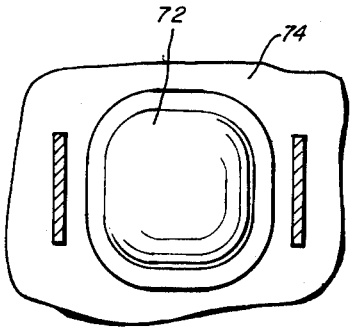
FIG. 8 is an illustration of the embodiment shown in FIG. 7 as seen along the line 8—8 of FIG. 7.

The invention may also be employed in connection with containers having rigid sidewalls. As shown in FIGS. 7 and 8 such a container is illustrated in the form of a paint or adhesive can made, for example, from metal. The container may be provided with the same general construction of latch arm and locking loop described above. A resilient, flexible protrusion 72 may be secured to the rigid container sidewall 74. In FIG. 7 the protrusion 72 is shown in phantom in its relaxed position and in solid in its deformed configuration when the handle 80 is in its mid-position. The protrusion 72 is dimensioned with respect to the location of the latch arm pivot 76 and the dimensions of the inner section 78 of the latch arm 80 to interfere with the inner section 78 as the latch arm 80 is pivoted between its unlocked and locked positions. For example, the protrusion 72 may be in the form of a bubble, as shown, formed from a tough, resilient and flexible plastic material. In this embodiment, however, the extension of the inner section 78 must be slightly less than the distance between the pivot bar 76 and the rigid container sidewall 74 but more than the distance between the pivot bar 76 and the outer surface of the protrusion 72. The lid 82 may be provided with a rigid, outwardly extending loop support 84 and the locking loops 86 may depend therefrom as suggested in the drawings. It may be desirable depending on the type of material contained within the container shown in FIG. 7, to provide a resilient gasket 88 in the channel 90 at the mouth of the container to enhance the seal with the bead 92 on the lid where this would be desirable depending on the material to be kept in the container.

It should be understood that the foregoing description of the invention is intended merely to be illustrative thereof and that other modifications and embodiments may be apparent to those skilled in the art without departing from its spirit.

Having thus described the invention what I desire to claim and secure by Letters Patent is:

1. An improved latch for a container and lid therefor comprising:

a latch arm having inner and outer ends;

means mounting said latch arm between its ends, to the exterior of the sidewall of said container below the rim thereof and for pivotal movement between a first and second position about a substantially transverse axis, said axis being spaced outwardly from the sidewall of said container;

said sidewall of said container, at least in the region thereof which is adjacent said pivotal axis, being of resilient, deformable and flexible construction, the distance between said pivotal axis and said region of said container sidewall being less than the distance from said pivotal axis to the extremity of said inner end of said latch arm, the relative dimensions and location of the pivotal axis, latch arm and said region of said container sidewall being such as to cause said region of said sidewall to yieldably obstruct said inner end of said latch arm as said latch arm is pivoted from one of its positions to the other, said region of said container sidewall being resiliently deformed when said latch is pivoted from one of its positions to the other and returning toward its substantially undeformed shape in said one or other positions, said region of said container sidewall being cooperative with the inner end of the latch arm, when the latch is in either of its positions, to retain the latch arm in that position;

a member connected to and extending downwardly from the periphery of the container lid, said member having a transverse portion which, when the lid is on the container, may extend downwardly and be engaged by a portion of said latch arm;

said portion of said latch arm including means for engaging said transverse portion of said member to retain said member and draw said lid member downwardly in response to pivotal movement of said latch arm from one position thereof to the other.

2. A device as defined in claim 1 wherein said flexible, deformable and resilient construction of said region of said sidewall is defined by said entire sidewall being formed from said resilient, deformable and flexible material.

3. A device as defined in claim 1 wherein said container has a rigid, relatively inflexible sidewall and further comprising:

a resilient, deformable and flexible member secured to the exterior of said container sidewall and extending outwardly therefrom, said inner end of said latch member extending from said pivot point a distance which is intermediate the distance between said pivot point and said rigid container sidewall and the distance between said pivot point and the outermost surface of said flexible, deformable and resilient member.

4. A device as defined in claim 1 further comprising:

said inner section of said handle being of smooth configuration and free of any sharp surfaces at least in the region thereof where it engages said resilient, deformable and flexible region of said sidewall.

5. A device as defined in claim 1 wherein said latch arm further comprises:

a transversely extending pivot bar having transverse ends;

said sidewall having trunnions secured thereto and disposed on opposite sides of said latch arm, said trunnions being pivotly receptive to the transverse ends of said pivot bar; and the inner end of said latch arm being secured to and integral with said transverse pivot bar, said inner end being of generally bowed configuration with its mid-portion spaced from said pivot bar.

6. A device as defined in claim 1 further comprising:

the outer end of said latch arm being constructed and arranged so that when said latch arm is in its locked position thereof, at least a portion of said outer end of said latch arm will extend away from the sidewall of said container to facilitate gripping of said latch.

7. A device as defined in claim 1 further comprising:

said pivotal axis being disposed below the rim of said container and at a location in relation to the length of said latch arm such that when said latch arm is in its fully unlocked position its outer end may extend above the rim of the container.

8. A device as defined in claim 1 further comprising;

said means on said portion of said member being so constructed in a range as to receive said member being in a snug, snap-in fit thereby to reduce the likelihood of separation of said lid from said latch arm.

9. A device as defined in claim 1 further comprising:

said first and second positions of the latch arm each extending substantially along the sidewall of the container but in opposite directions.

10. A device as defined in claim 9 wherein one of said directions is generally toward the upper end of the container and the other is toward the bottom end of the container.

* * * * *